United States Patent [19]

Bartlett et al.

[11] Patent Number: 4,920,351

[45] Date of Patent: Apr. 24, 1990

[54] DIPLEXER FOR ORTHOGONALLY POLARIZED TRANSMIT/RECEIVE SIGNALLING ON COMMON FREQUENCY

[75] Inventors: Homer E. Bartlett, Palm Bay; Kevin P. Gallagher, Indian Harbor Beach, both of Fla.

[73] Assignee: Computer Science Inovations, Inc., Palm Bay, Fla.

[21] Appl. No.: 843,008

[22] Filed: Mar. 24, 1986

[51] Int. Cl.[5] ..... H01Q 13/00; H01P 1/213

[52] U.S. Cl. ..... 343/756; 343/786; 333/126; 333/135

[58] Field of Search ..... 343/756, 776, 777, 786, 343/858; 333/126, 21 A, 135, 137

[56] References Cited

U.S. PATENT DOCUMENTS

| | | | |
|---|---|---|---|
| 2,735,092 | 2/1956 | Brown | 333/137 |
| 3,731,235 | 5/1973 | Ditullio et al. | 333/135 |
| 4,467,294 | 8/1984 | Janky et al. | 333/126 |
| 4,491,810 | 1/1985 | Saad | 333/135 |
| 4,498,062 | 2/1985 | Massaglia et al. | 333/137 |
| 4,630,059 | 12/1986 | Morz | 343/786 |

*Primary Examiner*—William L. Sikes
*Assistant Examiner*—Michael C. Wimer
*Attorney, Agent, or Firm*—Antonelli, Terry & Wands

[57] ABSTRACT

A microwave transmit/receive terminal having an antenna and associated feed for receiving vertically and horizontally polarized signals and for transmitting a horizontally polarized signal employs a diplexer to be inserted between the feed and an orthomode coupler. The diplexer is formed of a cylindrical waveguide main body, a first port of which is coupled to the feed for receiving the orthogonally polarized receive signals and for coupling thereto the (horizontally polarized) transmit signal. A second port of the main body is coupled to the orthomode coupler for receiving the horizontally polarized signal to be transmitted and for coupling thereto the vertically polarized receive signals. A rectangular waveguide section is coupled to the cylindrical waveguide main body and forms a third port for coupling the horizontally polarized received signal away from said cylindrical waveguide main body. A first filter is disposed within the cylindrical waveguide main body between the first and second ports for preventing the coupling of horizontally polarized receive signals between the first and second ports. A second filter is coupled with the rectangular waveguide section for passing the horizontally polarized receive signal while preventing the coupling of the horizontally polarized transmit signal to the third port.

20 Claims, 4 Drawing Sheets

DIPLEXER FOR ORTHOGONALLY POLARIZED TRANSMIT/RECEIVE SIGNALLING ON COMMON FREQUENCY

FIELD OF THE INVENTION

The present invention relates, in general, to communication systems and is particularly directed to a diplexer for a transmit/receive terminal employing orthogonally polarized signalling.

BACKGROUND OF THE INVENTION

Present day satellite communication systems conventionally employ orthogonally polarized signals for effecting two-way communications over the same channel. In general, one polarization (e.g. vertical) is assigned for signalling in one direction (e.g. earth station W (West)-satellite-earth station E (East)) while the other polarization (e.g. horizontal) is assigned for signalling in the opposite direcion (e.g. earth station E (East)-satellite-earth station W (West)). FIG. 1 shows a typical earth station having an antenna 11 and attendant feed 12, which is coupled via a section of cylindrical waveguide 13 to an I/O port 14 of an orthomode coupler 15. Orthomode coupler 15 has a first input port 16 to which a section of rectangular waveguide 18 is coupled. Waveguide section 18 couples transmit signals of a first polarization (e.g. horizontal) to input port 16. A separate section of rectangular waveguide 19 is coupled to an output port 17 of orthomode coupler 16 for coupling received signals of a second polarization (e.g. vertical), orthogonal to the first polarization, to receive/down conversion equipment (e.g. a downstream LNA). At the remote site earth station the polarizations for transmit and receive signals are reversed, so that the port connections are opposite those of FIG. 1.

As the number of applications for satellite usage increases, the desirability of taking advantage of both polarizations for additional signalling capability has been proposed. For example, a service industry facility, such as a hotel, may desire to add teleconferencing, video reception capability to its communication link, as by way of a horizontally polarized receive link. Unfortunately, because of packaging and mounting constraints on the orthomode coupler, it is often not possible to gain physical access to the downstream waveguide coupling hardware (e.g. rectangular waveguide section 18) for splitting off an additional (receive) horizontal polarization.

SUMMARY OF THE INVENTION

In accordance with the present invention, the inability of the complex mounting hardware, which couples the orthomode coupler to downstream transmit/receive components, to provide an interface capability for utilizing additional polarization (e.g. horizontal receive polarization signalling) is circumvented by a new and improved diplexer that is readily installed in the cylindrical waveguide section coupling the antenna feed to the orthomode coupler, i.e. upstream of the orthomode coupler, where there is normally sufficient space to accommodate an additional signal interface.

The diplexer according to the present invention has a first, cylindrical shaped main body, a first circular end port of which is coupled to a section of cylindrical waveguide from the antenna feed, and a second circular end port of which is coupled to a section of cylindrical waveguide feeding the orthomode coupler. The internal longitudinal cross-section of the cylindrically-shaped main body is essentially circular, so as to provide passage therethrough of both vertically and horizontally polarized signals. The internal diameter of each of the first and second circular end portions is tapered from its interface with coupling waveguide to the internal circular cross-section of the cylindrically shaped main body. The internal bore of the main body has a diameter sufficiently small to prevent asymmetry from causing the generation of an unwanted mode ($TM_{01}$) over the band of the receive signals (e.g. 11.7–12.2 GHz).

A first filter comprised of a tapered land section is disposed along a prescribed portion of the interior bore of the cylindrically shaped diplexer to effectively block the coupling of received horizontally polarized signals therethrough. Instead, the horizontal receive polarization is extracted through a rectangular side port waveguide section intersecting the cylindrically shaped main body of the diplexer in a direction normal to the longitudinal axis of the cylindrical main body and having parallel top and bottom walls parallel with that longitudinal axis. Parallel side walls of the rectangular waveguide section are parallel to the direction of polarization of the horizontally polarized receive signals. This rectangular side port waveguide section contains a bandpass filter which prevents the horizontally polarized transmit signal from being coupled out of the side port section. The diplexer further contains a dummy side port termination opposite the rectangular side port section, so as to provide symmetry to the transmit signal and prevent the generation of an unwanted mode ($TM_{01}$)in the transmit band. The short dummy side port termination presents the same impedance to the transmit frequency as the bandpass filter in the side port waveguide section.

DETAILED DESCRIPTION

Figure 1:
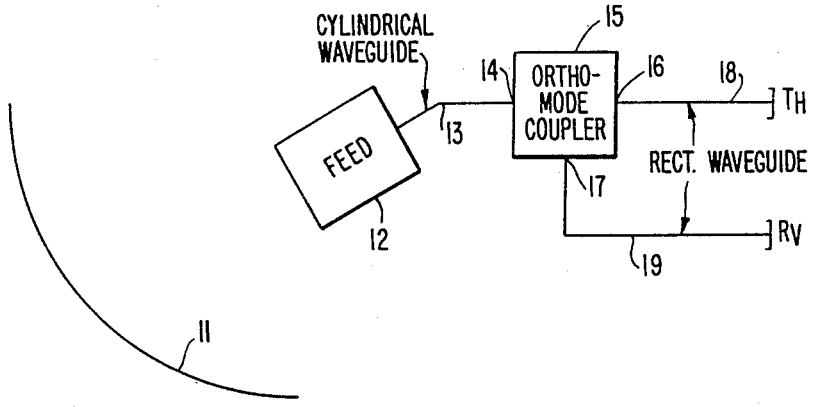
FIG. 1. (PRIOR ART)
FIG. 1 is a diagrammatic illustration of a prior art arrangement for coupling orthogonally polarized signals between an antenna feed and associated transmit/-receive ports.
Figure 2:
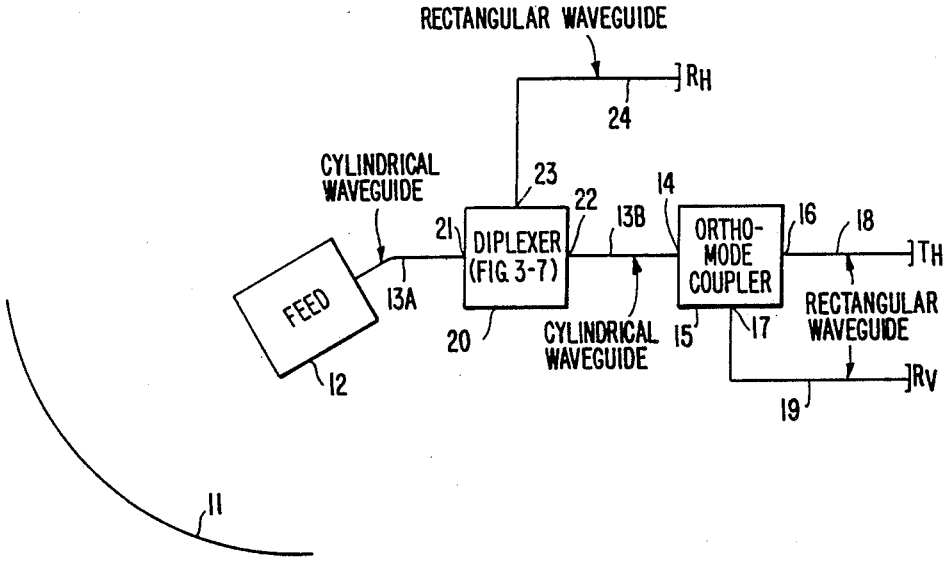
FIG. 2 is a diagrammatic illustration of the arrangement of a diplexer between the antenna feed and an orthomode coupler for interfacing orthogonal receive polarizations and a transmit polarization with the antenna feed.

Referring now to FIG. 2, there is shown a diagrammatic illustration of an arrangement for coupling orthogonally polarized signals between an antenna feed and respective transmit/receive signalling ports. As in the arrangement of FIG. 1, a feed 12 associated with an antenna 11 for receiving and transmitting orthogonally polarized signals (both vertical and horizontal components) is coupled to an orthomode coupler 15. Rather than being directly coupled by way of a circular waveguide section (such as 13 as in the prior art configuration of FIG. 1), the present invention incorporates a diplexer 20 between a first cylindrical waveguide section 13A which is coupled to the antenna feed 12, proper, and a second cylindrical waveguide section 13B which is coupled to an interface port 14 of an orthomode coupler 15. As will be described in detail below, the configuration of diplexer 20 is such that it performs the same coupling function as the cylindrical waveguide 13 of the embodiment of FIG. 1; in addition, it interfaces (or couples) a further (horizontal) receive polarization RH between a port 23 and a rectangular waveguide section 24. A transmit/receive port 22 of diplexer 20 is coupled to cylindrical waveguide section 13B for interfacing a transmit horizontal polarization TH supplied through orthomode coupler 15 from waveguide section 18 and for coupling a receive vertical polarization RV to port 14 of orthomode coupler 15 for application to waveguide section 19.

Referring now to FIGS. 3–7, the configuration of the diplexer of the present invention will be described in detail. As shown in a first side view of FIG. 3, the diplexer has a cylindrically shaped longitudinal main body section 35, respective ends of which are provided with circular flange portions 31 and 36 for coupling the diplexer to cylindrical waveguide section 13A and cylindrical waveguide section 13B, respectively. Circular flange 31 has opposite surfaces 32 and 33 between which a plurality of mounting holes (not shown) are provided; similarly, circular flange end 36 has opposite surfaces 37 and 38 between which a plurality of mounting bores or hole (shown at 51 in FIG. 6) are provided. The holes in the respective flanges provide a mechanism for affixing the diplexer to adjacent sections of cylindrical waveguide having similar flange portions. Internally, the cylindrically-shaped main body 35 of diplexer 20 is provided with a cylindrical conductive wall or bore 41 and may include one or more pairs of externally adjustable tuning screws (not shown) extending into the bore 41, as conventionally employed for fine tuning the diplexer to a desired set of operational parameters.

Figure 3:
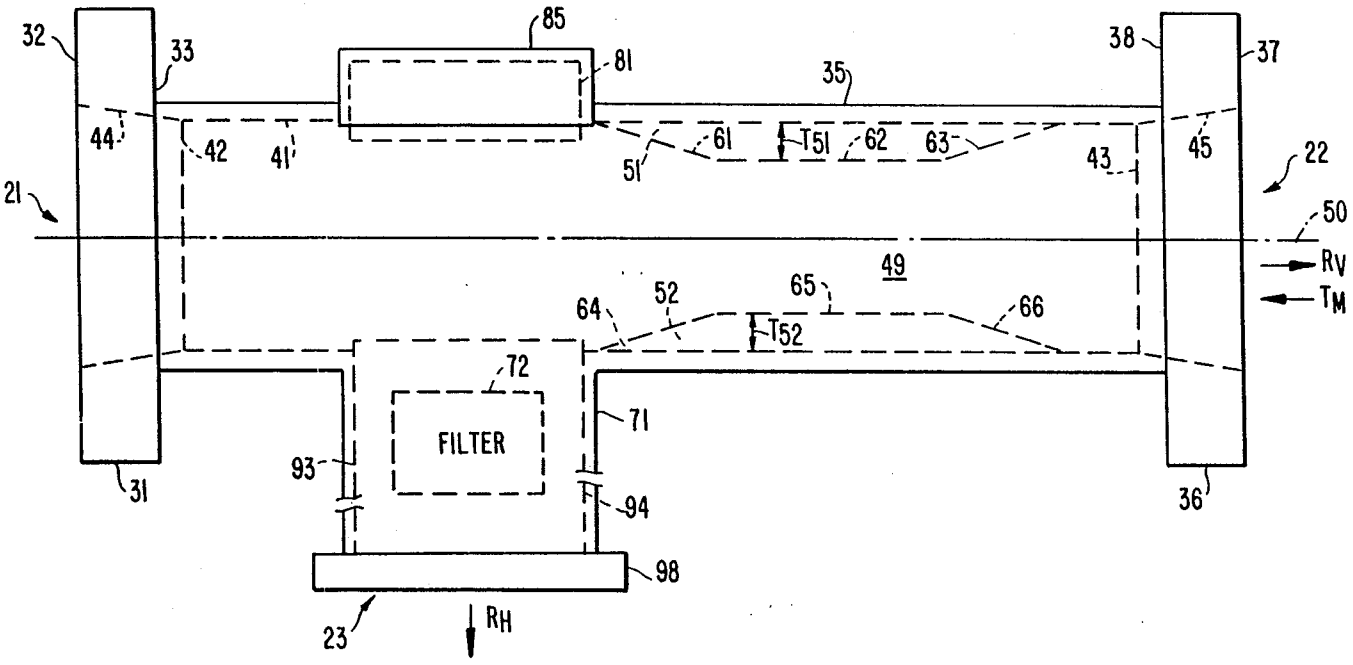
FIG. 3 is a side view of a diplexer in accordance with the present invention.
Figure 4:
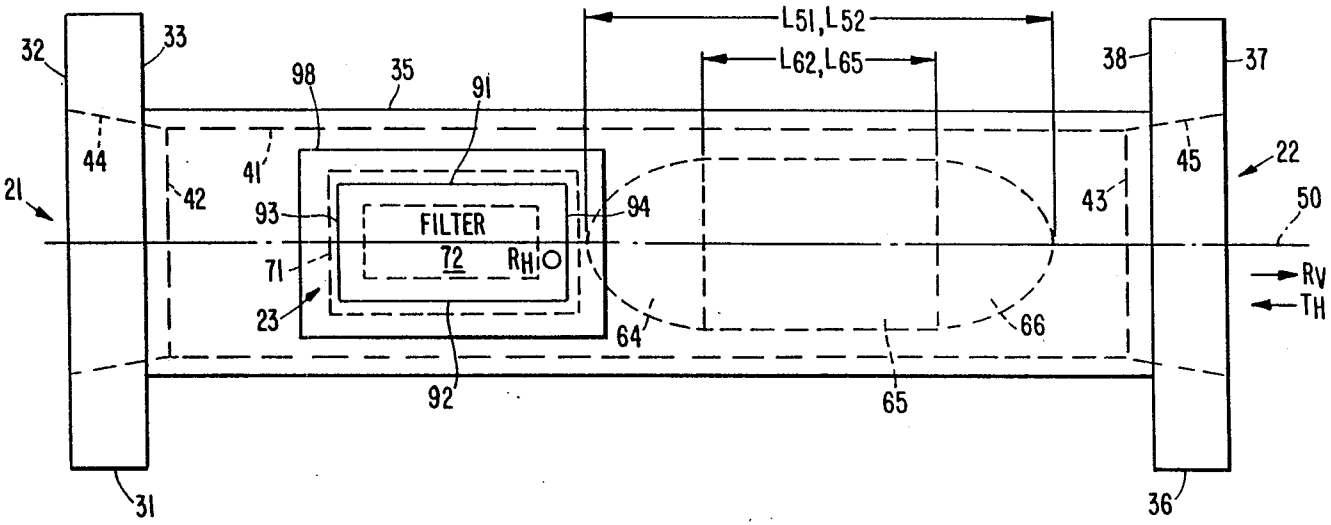
FIG. 4 is a further side view, orthogonal to that of FIG. 3, of a diplexer in accordance with the present invention.
Figure 5:
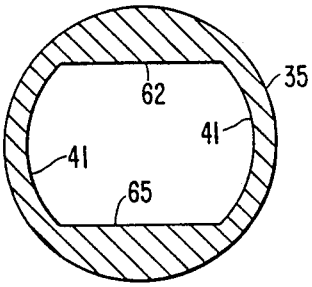
FIG. 5 is a cross-sectional view taken along line 5–5' of the diplexer shown in FIG. 3.
Figure 6:
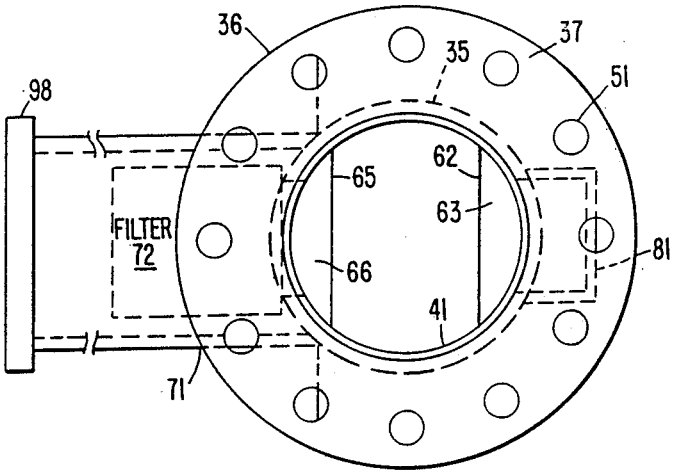
FIG. 6 is an end view of the diplexer shown in FIG. 4.

The diplexer itself may be formed from sections of milled and welded aluminum stock. Bore 41 is essentially circular in cross-section, terminating at end portions 42 and 43, as shown in FIGS. 3 and 4. From end portions 42 and 43, the internal circular wall or bore 41 transitions at flared regions 44 and 45 to an enlarged diameter matching the internal diameters of circular waveguide sections 13A and 13B so as to provide impedance matching between the main body 35 and larger diameter cylindrical waveguide coupled thereto at ports 21 and 22, respectively, In lieu of flared regions 44 and 45, other transition configurations, such as stepped regions, may be employed for providing the impedance match. As noted previously, the diameter of internal cylindrical bore 41 is sufficiently small so as to prevent asymmetry from causing an unwanted mode ($TM_{01}$) to be set up in the receive band (e.g. 11.7–12.2 GHz).

Disposed adjacent to the left-hand end 42 (as viewed in FIGS. 3 and 4) of the cylindrical waveguide main body 35 of the diplexer is a side port waveguide section 71 for coupling a received horizontal polarization, that has been introduced into the diplexer at port 21, to rectangular waveguide section 24 via port 23 (see FIG. 2). The rectangular side port waveguide section 71 has parallel top and bottom walls 91 and 92 which are parallel to the longitudinal axis 50 of the cylindrically shaped main body 35. Section 71 also has parallel side walls 93 and 94 intersecting the top and bottom side walls 91 and 92 and which terminate with side walls 91 and 92 at an end rectangular mounting flange 98. Rectangular side port waveguide section 71 contains a bandpass filter 72, diagrammatically shown in broken lines, which prevents the horizontally polarized transmit signal TH from being coupled out the side port section 23. Namely, filter 71 has a passband corresponding to the receive band (e.g. 11.7–12.2 GHz), so that it effectively blocks the higher frequency band (e.g. 14.0–14.5 GHz) transmit signal TH, whereby the horizontal polarization RH, which is blocked by a frequency selective, polarization filter 49 disposed in cylindrical main body 35, is forced into waveguide section 71 to be coupled out side port 23.

Intersecting the side of the cylindrical main body 35 of the diplexer opposite section 71 is a dummy side port 81 formed of a short section of rectangular waveguide, shorted by a metallic (e.g. aluminum) cap 85. This side port prevents the generation of unwanted modes ($TM_{01}$) of the transmit frequency, as it presents symmetry to the transmit horizontal polarized signal TH which is introduced into the diplexer at port 22 from cylindrical waveguide section 13B coupled to the right-hand portion of the configuration as viewed in FIGS. 3 and 4.

Figure 7:
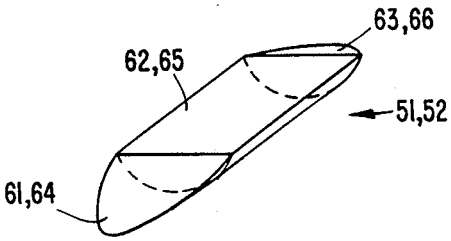
FIG. 7 is a pictorial view of a tapered land section of the horizontal polarization filter section disposed in the cylindrical main body portion of the diplexer of FIG. 3.

In order to prevent or block the coupling of the horizontal receive component RH through the cylindrical main body 35, a frequency selective, polarization filter section 49, comprised of a pair of truncated circular land regions 51 and 52 (shown in detail in FIG. 7), is disposed between the side port waveguide section 71 and the right-hand end 43 of the internal bore 41 of main body 35. As shown in FIG. 7, land portion 51 (52) includes a flat surface 62 (65) and tapered surfaces 61 (64) and 63 (66) which extend (form a transition) from the flat surface 62 (65) to the circular internal bore 41. As viewed in the direction of the axis of the side port waveguide section 71 (FIG. 4), tapered land portion 51 (52) has a generally rectangularly shaped central portion 62 (65) bounded by elliptical end faces 61 (64) and 63 (66) which extend to the cylindrically shaped fare 41. The flats or flat surfaces 62 and 65 of respective land portions 51 and 52 are parallel to the E-field vector for horizontal polarization. Each of tapered land portions 51 and 52 may be individually made and then inserted into the cylindrical bore 41 of main body 35 to be retained therein as by soldering. Alternatively, tapered land portions 51 and 52 may be cast as part of the interior configuration of main body 35.

For a range of transmission frequencies of 14.0–14.5 GHz the frequency of the horizontal polarized transmit signal TH is selected to be above the cut-off imparted by filter section 49, so that the horizontal transmission component TH from waveguide section 13B entering the right-hand portion of the diplexer (as viewed in FIGS. 3 and 4) passes through the main body 35 of the diplexer and exits via circular waveguide section 13A at port 21. Typically, the orthogonally polarized receive signals RH, RV may fall within a frequency range of 11.7–12.2 GHz. The cross-section of the filter section 49 is dimensioned so that signals in this frequency range are below the cut-off of the filter section 49 for polarization parallel to the flats 62, 65, so that all of the energy of the received horizontal component RH will be directed out the side port waveguide section 71.

The received vertical component RV which enters port 21, because it is perpendicular to the flats 62, 65, is not below cut-off in filter section 49, so that it passes through the diplexer and exits port 22 for entry into the cylindrical waveguide section 13B and is coupled thereby to the orthomode coupler 15.

For a receive frequency range of 11.7–12.2 GHz, the diameter $D_{41}$ of internal bore 41 may lie in a range of from 0.62 inches to 0.74 inches. The thicknesses $T_{51}$, $T_{52}$ of sections 51, 52 may be such that the separation between the surfaces 62 and 65 lies in a range of from 0.43 inches to 0.48 inches, while the lengths $L_{62}$, $L_{65}$ of flat land areas 62, 65 of tapered land sections are 0.25 inches or greater. The maximum lengths $L_{62}$, $L_{65}$ are determined by the desired attenuation of the transmitter-generated spurious signals in the receive band which are also horizontally polarized (length is directly proportional to attenuation) and constraints on physical length of the overall assembly. The taper angle $\alpha_T$ of inclined portions 61, 63, 64, 66 may lie in a range of from 5° to 90° (namely, from a very gradual slope to an abrupt step transition). Moreover rather than employ a continuous taper, or single step, the ends of land regions 51 and 52 may be step-wise tiered from flat land areas 62, 65 to the interior bore 41 of main body 35.

Advantageously, the overall length of the diplexer is only on the order of 5 inches so that is easily insertable in the waveguide section 13 which couples the antenna feed 12 with the orthomode coupler 15, where there is sufficient space to accommodate signal splitting hardware.

While we have shown and described an embodiment in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

What is claimed:

1. A microwave coupling device comprising:

a first waveguide section having a first end which forms a first port of said device and a second end which forms a second port of said device, said first port coupling into said first waveguide section a first signal, lying in a first frequency band, having a first polarization and a second signal, lying in said first frequency band, having a second polarization orthogonal to said first polarization, said second port coupling into said first waveguide section a third signal having said second polarization and lying in a second frequency band, higher than said first frequency band;

a second waveguide section having one end thereof coupled to said first waveguide section at a location between the first and second ends thereof and having a second end forming a third port of said device;

frequency selective, polarization filter means, disposed within said first waveguide section between said location and the second end of said first waveguide section, for preventing said second signal from being coupled from said location to said second port, while permitting the passage of said first and third signals through said first waveguide section between said first and second ports; and frequency filter means, disposed within said second waveguide section and having a passband corresponding to said first frequency band, for passing said second signals therethrough while preventing the coupling of said third signals between said location and said third port.

2. A microwave coupling device according to claim 1, wherein said first waveguide section comprises a cylindrical waveguide section and said second waveguide section comprises a rectangular waveguide section.

3. A microwave coupling device according to claim 2, wherein said polarization filter means comprises a plurality of land sections extending from the cylindrical wall of said cylindrical waveguide section, each land section having a flat surface portion which is parallel to the direction of said second polarization.

4. A microwave coupling device according to claim 3, wherein each of said land sections further comprises a pair of transition portions extending from said flat surface portion to the cylindrical wall of said cylindrical waveguide section.

5. A microwave coupling device according to claim 1, further comprising a shorted waveguide section joined to said first waveguide section at position opposite to said second waveguide section, for effectively preventing the generation of a prescribed electromagnetic wave mode at the frequency of said third signal.

6. A microwave coupling device according to claim 5, wherein said mode is the $TM_{01}$ mode.

7. A microwave coupling device according to claim 1, further comprising termination impedance means, joined to said first waveguide section at position opposite to said second waveguide section, for effectively presenting the same impedance as said frequency filter means to said third signal.

8. A microwave coupling device according to claim 2, wherein the internal cylindrical wall of said waveguide section has a transition at each its first and second ends to provide a coupling match for orthogonally polarized signals being interfaced at said first and second ports, respectively.

9. A microwave coupling device according to claim 2, wherein said first port is configured to be joined with cylindrical waveguide for interfacing orthogonally polarized signals with an antenna feed and said second port is configured to be joined with cylindrical waveguide for interfacing orthogonally polarized signals with a transmit/receive apparatus.

10. A microwave coupling device according to claim 9, wherein said first and second signals respectively correspond to vertically and horizontally polarized receive signals derived from said antenna feed and said third signal corresponds to a horizontally polarized transmit signal to be coupled to said antenna feed.

11. For use with a microwave transmit/receive terminal having an antenna and an associated feed for receiving each of a first signal, lying in a first frequency band, having a first polarization, and a second signal, lying in said first frequency band, having a second polarization orthogonal to said first polarization, and for transmitting a third signal having said second polarization and lying in a second frequency band, higher than said first frequency band, a microwave coupling device, insertable between said feed and an orthomode coupler, comprising:

a first waveguide section having a first end which forms a first port of said device and a second end which forms a second port of said device, said first port coupling from said feed into said first waveguide section said first and second signals received by said antenna, and said second port coupling from said orthomode coupler into said first waveguide section said third signal to be transmitted and for coupling to said orthomode coupler said first signal;

a second waveguide section having one end thereof coupled to said first waveguide section at a location between the first and second ends thereof and having a second end forming a third port of said device, said third port coupling therethrough said second signal;

frequency selective, polarization filter means, disposed within said first waveguide section between said location and the second end of said first waveguide section, for preventing said second signal from being coupled from said location to said second port, while permitting the passage of said first and third signals through said first waveguide section between said first and second ports; and frequency filter means, disposed within said second waveguide section and having a passband corresponding to said first frequency band, for passing said second signals therethrough while preventing the coupling of said third signals between said location and said third port.

12. A microwave coupling device according to claim 11, wherein said first waveguide section comprises a cylindrical waveguide section and said second waveguide section comprises a rectangular waveguide section.

13. A microwave coupling device according to claim 12, wherein said polarization filter means comprises a plurality of land sections extending from the cylindrical wall of said cylindrical waveguide section, each land section having a flat surface portion which is parallel to the direction of said second polarization.

14. A microwave coupling device according to claim 13, wherein each of said land section further comprises a pair of transition portions extending from said flat surface portion to the cylindrical wall of said cylindrical waveguide section.

15. A microwave coupling device according to claim 11, further comprising a shorted waveguide section joined to said first waveguide section at position opposite to said second waveguide section, for effectively preventing the generation of a prescribed electromagnetic wave mode at the frequency of said third signal.

16. A microwave coupling device according to claim 15, wherein said mode is the $TM_{01}$ mode.

17. A microwave coupling device according to claim 11, further comprising termination impedance means, joined to said first waveguide section at position opposite to said second waveguide section, for effectively presenting the same impedance as said frequency filter means to said third signal.

18. A microwave coupling device according to claim 12, wherein the internal cylindrical wall of said waveguide section has a transition at each its first and second ends to provide a coupling match for orthogonally polarized signals being interfaced at said first and second ports, respectively.

19. A microwave coupling device according to claim 12, wherein said first port is configured to be joined with cylindrical waveguide for interfering orthogonally polarized signals with said antenna feed and said second port is configured to be joined with cylindrical waveguide for interfacing orthogonally polarized signals with said orthomode coupler.

20. A microwave coupling device according to claim 19, wherein said first and second signals respectively correspond to vertically and horizontally polarized receive signals derived from said antenna feed and said third signal corresponds to a horizontally polarized transmit signal to be coupled to said antenna feed.

* * * * *